US010621813B2

(12) United States Patent
Fujita

(10) Patent No.: US 10,621,813 B2
(45) Date of Patent: Apr. 14, 2020

(54) RECORDING MEDIUM STORING GAME PROGRAM, GAME PROCESSING METHOD, AND INFORMATION PROCESSING APPARATUS

(71) Applicant: GREE, Inc., Tokyo (JP)

(72) Inventor: Hideki Fujita, Tokyo (JP)

(73) Assignee: GREE, Inc., Tokyo (JP)

( * ) Notice: Subject to any disclaimer, the term of this patent is extended or adjusted under 35 U.S.C. 154(b) by 741 days.

(21) Appl. No.: 14/690,549

(22) Filed: Apr. 20, 2015

(65) Prior Publication Data

US 2015/0302687 A1 Oct. 22, 2015

(30) Foreign Application Priority Data

Apr. 21, 2014 (JP) ..... 2014-087003

(51) Int. Cl.
*G07F 17/32* (2006.01)
*G07F 17/34* (2006.01)

(52) U.S. Cl.
CPC ..... *G07F 17/3213* (2013.01); *G07F 17/34* (2013.01)

(58) Field of Classification Search
CPC ..... G07F 17/34; G07F 17/3213
USPC ..... 463/20
See application file for complete search history.

(56) References Cited

U.S. PATENT DOCUMENTS

2005/0181861 A1* 8/2005 Kodachi ..... G07F 17/34 463/20
2007/0026937 A1* 2/2007 Yokoyama ..... G07F 17/34 463/25
2007/0281775 A1* 12/2007 Kashima ..... G07F 17/32 463/20
2007/0293298 A1* 12/2007 Okada ..... G07F 17/3202 463/20
2008/0254861 A1* 10/2008 Gatto ..... G07F 17/32 463/20
2008/0287175 A1* 11/2008 Kusuda ..... A63F 13/12 463/17

(Continued)

FOREIGN PATENT DOCUMENTS

JP 2001-216383 8/2001
JP 2001-216383 A 8/2001

(Continued)

OTHER PUBLICATIONS

Battle Slots released before Jul. 11, 2011 ("Battle Slots"). Evidence of gameplay of Battle Slots is provided by at the following online resource: a video provided by the video-sharing website named YouTube found at <https://www.youtube.com/watch?v=cuS8PwNAjFE> ("the Battle Slots YouTube Video").*

(Continued)

*Primary Examiner* — Omkar A Deodhar
*Assistant Examiner* — Shauna-Kay Hall
(74) *Attorney, Agent, or Firm* — Oblon, McClelland, Maier & Neustadt, L.L.P.

(57) ABSTRACT

A recording medium storing a game program processing progress of a game using a game content, the game program executes instructions including receiving, displaying, and determining. During determining, an action of the game content for the progress of the game is determined according to a combination of predetermined symbols displayed during displaying.

23 Claims, 7 Drawing Sheets

(56) References Cited

U.S. PATENT DOCUMENTS

| | | | | |
|---|---|---|---|---|
| 2009/0233680 | A1* | 9/2009 | Yoshizawa | G07F 17/3244 463/20 |
| 2013/0244748 | A1* | 9/2013 | Kitamura | G07F 17/3265 463/20 |
| 2014/0256403 | A1* | 9/2014 | Caputo | G07F 17/3267 463/20 |
| 2014/0295937 | A1* | 10/2014 | Takahashi | G07F 17/326 463/20 |
| 2014/0295938 | A1* | 10/2014 | Takahashi | G07F 17/326 463/20 |
| 2015/0161852 | A1* | 6/2015 | Robbins | G07F 17/34 463/20 |

FOREIGN PATENT DOCUMENTS

| | | |
|---|---|---|
| JP | 2010-057890 | 3/2010 |
| JP | 2011-55915 | 3/2011 |
| JP | 2012-40059 | 3/2012 |
| JP | 2013-212263 | 10/2013 |

OTHER PUBLICATIONS

Decision of Rejection dated Nov. 17, 2015 of corresponding Japanese Application No. 2014-261140 along with an English translation.

Japanese Content of Pre-Appeal Examination Report of corresponding Japanese Application No. 2014-087003 dated Jan. 15, 2015 with English translation.

Japanese Decision of Rejection of corresponding Japanese Application No. 2014-087003 dated Oct. 14, 2014 with English translation.

Japanese Notice of Reasons for Rejection of corresponding Japanese Application No. 2014-087003 dated Jul. 1, 2014 with English translation.

Saint Seiya Cosmo Slottle, Dengeki Game Application vol. 13, Kadokawa Corporation, Dec. 14, 2013, six (6) pages, with English summary.

Japanese Notice of Reasons for Rejection along with an English translation dated Jul. 7, 2015 from corresponding Japanese Application No. 2014-261140.

Kishin Douji ZENKI Tenchi Meidou Manual, Hudson Soft Company, Limited, Aug. 2, 2004, received by National Center for Industrial Property Information, pp. 1-30 along with an English summary (3 sheets).

* cited by examiner

FIG. 3

| PLAYER ID | CHARACTER 1 | CHARACTER 2 | CHARACTER 3 | CHARACTER 4 | CHARACTER 5 |
|---|---|---|---|---|---|
| 00001 | RABBIT | ELEPHANT | PIG | LION | SNAKE |
| 00002 | CAT | DOG | RABBIT | RACCOON | RAT |
| 00003 | MONKEY | SHEEP | OX | SNAKE | RABBIT |
| 00004 | DUCK | RAT | FROG | FOX | PIG |
| 00005 | ELEPHANT | RACCOON | DUCK | CAT | FOX |
| 00006 | SHEEP | OX | LION | BEAR | MONKEY |
| ... | ... | ... | ... | ... | ... |
| ... | ... | ... | ... | ... | ... |
| ... | ... | ... | ... | ... | ... |
| ... | ... | ... | ... | ... | ... |
| ... | ... | ... | ... | ... | ... |

FIG. 4

| GAME CONTENT NAME (CHARACTER NAME) | RARITY | ATTRI-BUTE | INITIAL LEVEL | INITIAL ATTACK POWER | INITIAL HEALTH POINT | SPEED | REQUIRED ABILITY POINT (AP) | SPECIAL MOVE | SUPPORT SKILL | SLOT | ... |
|---|---|---|---|---|---|---|---|---|---|---|---|
| RABBIT | N | ICE | 1 | 50 | 50 | 100 | 5 | USA KICK | SPEED UP | A | ... |
| ELEPHANT | GR | ICE | 1 | 80 | 100 | 50 | 10 | NOSE PUNCH | DEFENSE POWER UP | A | ... |
| PIG | N | WATER | 1 | 50 | 60 | 60 | 5 | BOO BOO KICK | HEALTH POINT RECOVERY | B | ... |
| LION | SR | THUNDER | 1 | 150 | 80 | 80 | 10 | GAO PUNCH | ATTACK POWER UP | C | ... |
| SNAKE | R | THUNDER | 1 | 100 | 40 | 20 | 5 | GURU GURU PUNCH | TOLERANCE UP | C | ... |
| ... | ... | ... | ... | ... | ... | ... | ... | ... | ... | ... | ... |
| ... | ... | ... | ... | ... | ... | ... | ... | ... | ... | ... | ... |

FIG. 5

| SLOT | SYMBOL 1 | SYMBOL 2 | SYMBOL 3 | SYMBOL 4 | SYMBOL 5 | SYMBOL 6 | SYMBOL 7 | SYMBOL 8 | ... |
|---|---|---|---|---|---|---|---|---|---|
| A | GRAPE | 7 | ICE | CHERRY | WATERMELON | BELL | BAR/BAR | BAR | ... |
| B | GRAPE | 7 | WATER | CHERRY | WATERMELON | BELL | BAR/BAR | BAR | ... |
| C | GRAPE | 7 | THUNDER | CHERRY | WATERMELON | BELL | BAR/BAR | BAR | ... |
| ... | ... | ... | ... | ... | ... | ... | ... | ... | ... |

RECORDING MEDIUM STORING GAME PROGRAM, GAME PROCESSING METHOD, AND INFORMATION PROCESSING APPARATUS

TECHNICAL FIELD

This disclosure relates to a recording medium storing a game program, a game processing method, and an information processing apparatus, and in particular, to a recording medium storing a game program, a game processing method and, an information processing apparatus which process the progress of a game using a game content.

BACKGROUND

A download method is known in Japanese Patent Application Laid-Open No. 2001-216383, in which, if a player operates a predetermined button on an information processing apparatus to provide an instruction to stop rotation of a plurality of slots, the type of content and/or number of contents to be downloaded are determined according to patterns arranged in the slots.

The above-described download method determines the type of content and/or the number of contents by the slots, that is, is merely a type of "lottery" which determines "win" or "lose".

The question arises, however, as to whether or not the result of the slots can be used for decision making in the progress of the game. The result is that an action of a character of a player in the game is determined according to the result of the slots.

It could therefore be helpful to improve the interest in a game by determining an action of a character of a player in the game according to the result of the slots.

SUMMARY

I thus provide a recording medium storing a game program which processes the progress of a game using a game content, the game program when executed on a computer to execute instructions to receive a stop operation to stop a plurality of slots sequentially replacing and providing predetermined symbols to the player of the game from the player, to display a combination of the predetermined symbols provided to the player according to the timing of the reception of the stop operation during receiving, and to determine an action of the game content for the progress of the game according to the combination of the predetermined symbols displayed during displaying.

I also provide a recording medium, which further executes: storing each of the plurality of slots in association with the game content.

I also provide a recording medium, wherein predetermined symbols in each of the plurality of slots are constituted based on information set in the associated game content.

I also provide a recording medium, which further executes: increasing and decreasing at least one of the number of slots and the speed at which the slots replace the predetermined symbols.

I also provide a recording medium, wherein, during receiving, the stop operation corresponding to each of the plurality of slots is received from each of a plurality of players.

I also provide a recording medium, which further executes: communicating a message enabling communication relating to an intended combination of symbols among the plurality of players.

I also provide a recording medium, wherein the game is a game in which the player battles with another player or a computer-controlled character using the game content.

I also provide a recording medium, wherein the action determined during determining is an action of attack or defense against another player or the computer-controlled character.

I further provide a game processing method which processes the progress of a game using a game content, the game processing method including receiving a stop operation to stop a plurality of slots sequentially replacing and providing predetermined symbols to the player of the game from the player, displaying a combination of the predetermined symbols provided to the player according to the timing of the reception of the stop operation during receiving, and determining an action of the game content for the progress of the game according to the combination of the predetermined symbols displayed during displaying.

I also provide a game processing method, further including storing each of the plurality of slots in association with the game content.

I also provide a game processing method, wherein predetermined symbols in each of the plurality of slots are constituted based on information set in the associated game content.

I also provide a game processing method, further including increasing and decreasing at least one of the number of slots and the speed at which the slots replace the predetermined symbols.

I also provide a game processing method, wherein, during receiving, the stop operation corresponding to each of the plurality of slots is received from each of a plurality of players.

I also provide a game processing method, further including communicating a message enabling communication relating to an intended combination of symbols among the plurality of players.

I further provide an information processing apparatus which processes the progress of a game using a game content, including a reception unit which receives a stop operation to stop a plurality of slots sequentially replacing and providing predetermined symbols to the player of the game from the player, a display unit which displays a combination of the predetermined symbols provided to the player according to the timing of the reception of the stop operation by the reception unit, and a determination unit which determines an action of the game content for the progress of the game according to the combination of the predetermined symbols displayed by the display unit.

I also provide an information processing apparatus, further including a storage unit which stores each of the plurality of slots in association with the game content.

I also provide an information processing apparatus, wherein predetermined symbols in each of the plurality of slots are constituted based on information set in the associated game content.

I also provide an information processing apparatus, further including an increasing/decreasing unit which increases and decreases at least one of the number of slots and the speed at which the slots replace the predetermined symbols.

I also provide an information processing apparatus, wherein the reception unit receives the stop operation corresponding to each of the plurality of slots from each of a plurality of players.

I also provide an information processing apparatus, further including a communication unit which communicates a message enabling communication relating to an intended combination of symbols among the plurality of players.

According to the recording medium storing a game program, the game processing method, and the information processing apparatus, it is possible to improve the interest in a game by determining an action of a character of a player in the game according to the result of the slots.

BRIEF DESCRIPTION OF THE DRAWINGS

FIG. 3 illustrates an example of a table which is managed in a storage unit.

FIG. 4 illustrates an example of a table which is managed in the storage unit.

FIG. 5 illustrates an example of a table which is managed in the storage unit.

DESCRIPTION OF REFERENCE SIGNS

Figure 1:
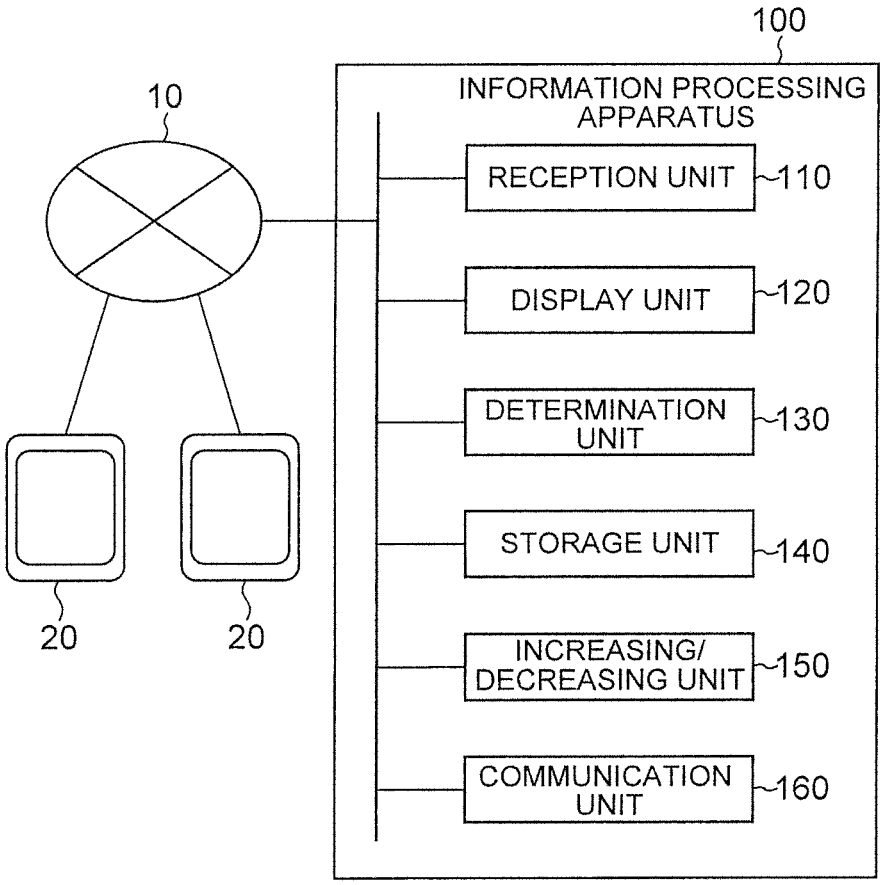
FIG. 1 is an example of a schematic block diagram of an information processing apparatus.

100: information processing apparatus
110: reception unit
120: display unit
130: determination unit
140: storage unit
150: increasing/decreasing unit
160: communication unit

DETAILED DESCRIPTION

First, an example of an information processing apparatus will be described in detail referring to the drawings.

FIG. 1 is a functional block diagram illustrating an example of an information processing apparatus according to one example. As illustrated in FIG. 1, an information processing apparatus 100 is an information processing apparatus which processes the progress of a game using a game content, and includes a reception unit 110, a display unit 120, and a determination unit 130. FIG. 1 illustrates an example where the information processing apparatus 100 connects to one or more player terminals 20 through a network 10.

The game content is a general term for electronic data used by a player for the progress of a game and can include, for example, a card, an item, a character, an avatar or the like.

In this example, although when the game is a game in which the player battles with another player or a computer-controlled character using the game content has been described, this disclosure is not limited thereto.

The reception unit 110 receives a stop operation to stop a plurality of slots sequentially replacing and providing predetermined symbols to the player of the game from the player. The player may be one player (single-play) or may be a plurality of players (multi-play). The details will be described below.

Figure 2:
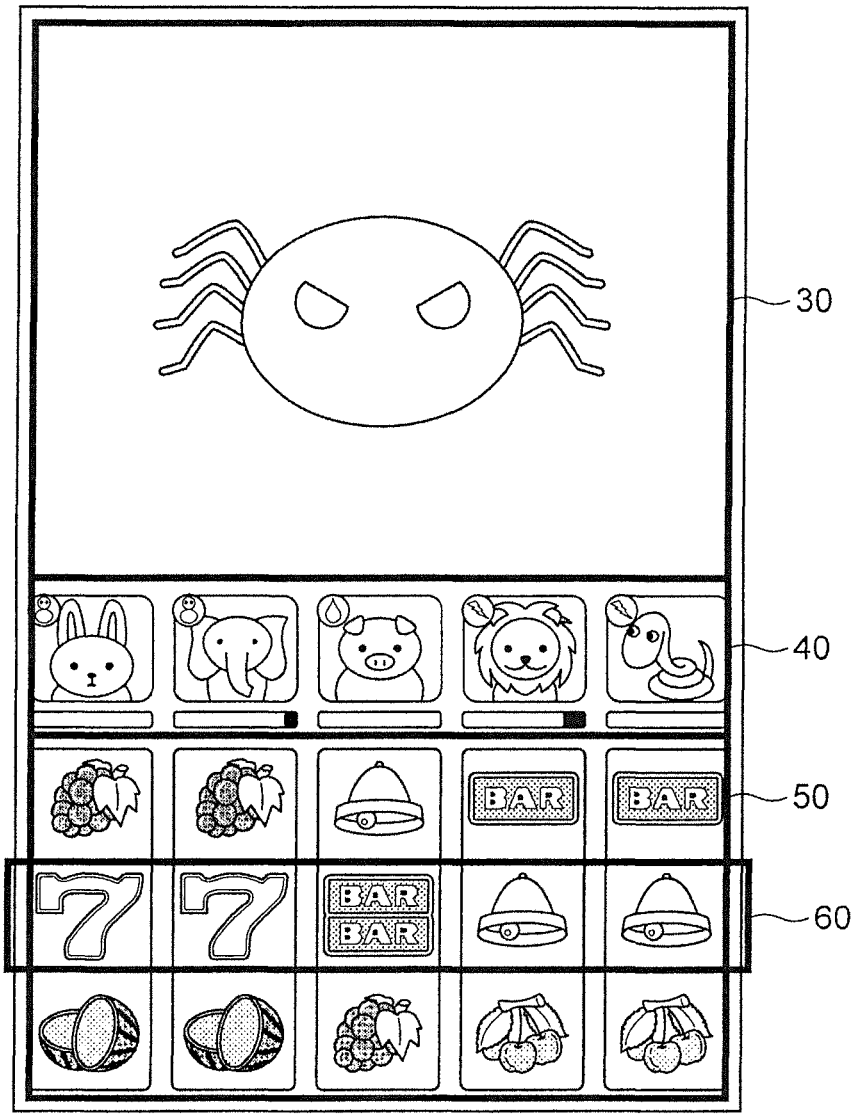
FIG. 2 is a schematic view illustrating an example of a game screen which is generated by the information processing apparatus.

FIG. 2 schematically illustrates an example of a game screen generated by the information processing apparatus 100. The game screen can be displayed on a display of a player terminal 20.

As illustrated in FIG. 2, a displaying region for an opponent 30, a displaying region for a game content information 40, and a displaying region for slots 50 can be displayed on the game screen.

A game content of another player or a computer-controlled character who becomes an opponent can be displayed on the displaying region for an opponent 30.

A game content disposed by the player and information thereof can be displayed on the displaying region for a game content information 40. In FIG. 2, in a single-play, a plurality of game contents disposed by one player and a residual rate of a health point of each game content as information of these game contents are displayed.

A slot associated with each of the game contents displayed on the displaying region for a game content information 40 can be displayed on the displaying region for slots 50. Specifically, a displayed game content and a slot displayed directly below the game content are associated with each other.

As illustration in FIG. 2, the slot can be a slot which has predetermined symbols drawn thereon and is rotated to sequentially replace and to provide the symbols to the player.

In FIG. 2, although the symbols are fruits, numerals, or characters, this disclosure is not limited thereto, and arbitrary patterns such as animals or characters, or colors may be used.

The stop operation can be, for example, an operation to touch each slot by the player on the displaying region for slots 50 which is an operation area. Alternatively, the stop operation may be an operation to press a key corresponding to each slot.

The display unit 120 displays a combination of the predetermined symbols provided to the player according to the timing of the reception of the stop operation by the reception unit 110.

In FIG. 2, a combination of predetermined symbols provided to the player is surrounded by a frame 60. In FIG. 2, although a combination of symbols arranged in a row is provided, the number of slots may be adjusted and a combination of symbols obliquely arranged may be provided.

The determination unit 130 (see FIG. 1) determines an action of the game content for the progress of the game according to the combination of the predetermined symbols displayed by the display unit 120.

The action determined in the determination unit 130 can be, for example, an action of attack or defense against another player or a computer-controlled character. The action may be an action of a game content involved in the progress of a quest or the accomplishment of a mission. For example, the action can be an action to determine a quest to be selected among a plurality of quests, to determine a treasure chest to be acquired and opened during a guest, to determine a branch road to be selected during a quest, to place a quest in a completion state, to increase the progress speed of a quest or the like by a combination of symbols.

In this way, according to the information processing apparatus 100, an action of the game content for the progress of the game is determined according to the displayed combination of the predetermined symbols. In other words, an action of a character of a player in the game is determined according to the result of the slots, whereby the interest in the game can be improved.

The effect of the action can be changed according to a combination of symbols. Specifically, when all symbols surrounded by the frame 60 are the same, an effect of 120% can be exhibited, and when a part of the symbols is the same, an effect of 80% can be exhibited. When the symbols are arranged in a specific combination, a special action including a special attack such as invocation of a skill may be performed.

As illustrated in FIG. 1, the information processing apparatus 100 of this disclosure can further include a storage unit 140.

The storage unit 140 stores each of a plurality of slots in association with a game content. The storage unit 140 stores a plurality of game contents. The storage unit 140 can have, for example, at least one of a semiconductor memory, a magnetic disk device, and an optical disk device. The storage unit 140 stores various programs and data which are used to control the information processing apparatus 100 of this disclosure. The storage unit 140 stores, for example, a program which executes a game and outputs the result thereof. The storage unit 140 also stores a program to execute event processing. The storage unit 140 may temporarily store temporary data pertaining to predetermined processing.

FIG. 3 is a diagram illustrating an example of a table which is managed in the storage unit 140 and in which an ID of a player is associated with a game content held by the player. In the example illustrated in FIG. 3, the ID of the player is associated with a character drawn on a game content. As illustrated in FIG. 3, the storage unit 140 can have data in the form of a table. The number of game contents held by the player may not be limited.

Predetermined symbols in each of a plurality of slots can be constituted based on information set in the associated game content.

Information set in the game content can be information regarding the name of the game content, rarity, attribute, level, attack power, health point, speed, required ability point (AP), special move, support skill and the like.

The attribute can be, for example, three kinds of ice, water, and thunder, and the superiority and inferiority relationship of water>ice, ice>thunder, and thunder>water can be set.

FIG. 4 is a diagram illustrating an example of a table which is managed in the storage unit 140 and in which a game content is associated with information set in the game content. As illustrated in FIG. 4, the storage unit 140 can have data in the form of a table.

FIG. 5 is a diagram illustrating an example of a table which is managed in the storage unit 140 and in which a slot is associated with the symbols of the slot. As illustrated in FIG. 5, the storage unit 140 can have data in the form of a table.

In this example, predetermined symbols in each of a plurality of slots can be constituted based on information of the attribute set in the associated game content.

Figure 6A:
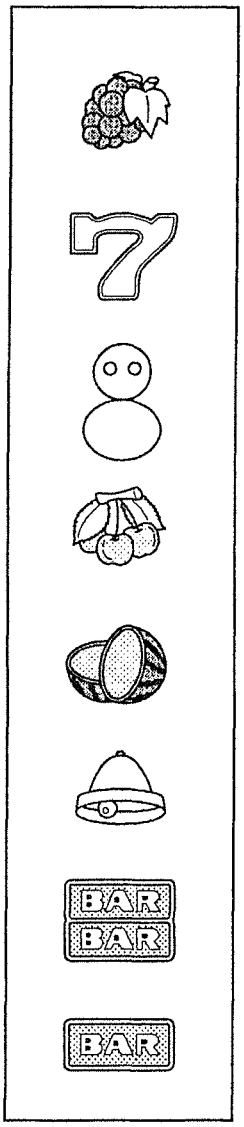
FIGS. 6A to 6C are schematic views illustrating an example of symbols of a slot.
Figure 6B:
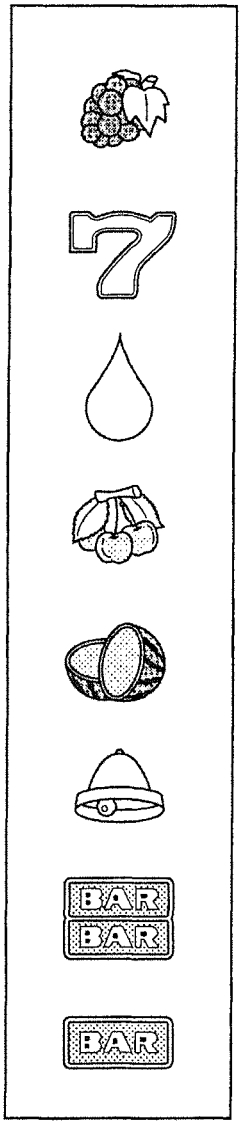
Figure 6C:
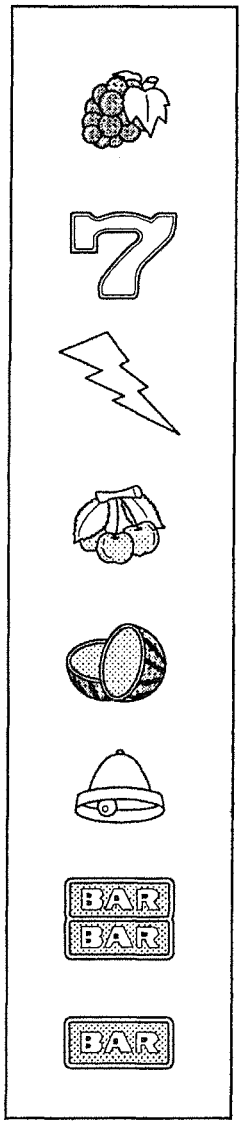

Specifically, when the attribute of a game content is ice, as illustrated in FIG. 6A, a slot associated with the game content can include a symbol representing ice. Similarly, when the attribute of a game content is water, or when the attribute of a game content is thunder, as illustrated in FIG. 6B or 6C, the game content can include a symbol representing the attribute thereof.

With this configuration, the game contents having the same attribute are used, whereby the slots are easily arranged. If the game contents having different attributes are used, the slots are not easily arranged, but a special action can be achieved by a special combination.

As illustrated in FIG. 1, the information processing apparatus 100 can further include an increasing/decreasing unit 150.

The increasing/decreasing unit 150 can increase and decrease at least one of the number of slots to be provided and the speed at which the slots replace the predetermined symbols.

For example, when the number of slots to be provided is increased, the symbols of the slots are not easily arranged, but the power and effect of an action executed when the symbols are arranged can be increased. When the number of slots is decreased, the symbols of the slots are easily arranged, but even if the symbols are arranged, the power and effect of an action to be executed can be decreased.

Similarly, when the speed of replacing the symbols is increased, the symbols of the slots are not easily arranged, and when the speed of replacing the symbols is decreased, the symbols of the slots are easily arranged. For example, the increasing/decreasing unit 150 can increase the speed of replacing the symbols when an enemy becomes stronger and the level of the player becomes higher. The increasing/decreasing unit 150 can decrease the speed of replacing the symbols when the player uses a specific item.

The difficulty of the game for the player can be changed by the increasing/decreasing unit 150.

As described above, the reception unit 110 can receive the stop operation corresponding to each of the plurality of slots from each of a plurality of players (multi-play).

Figure 7:
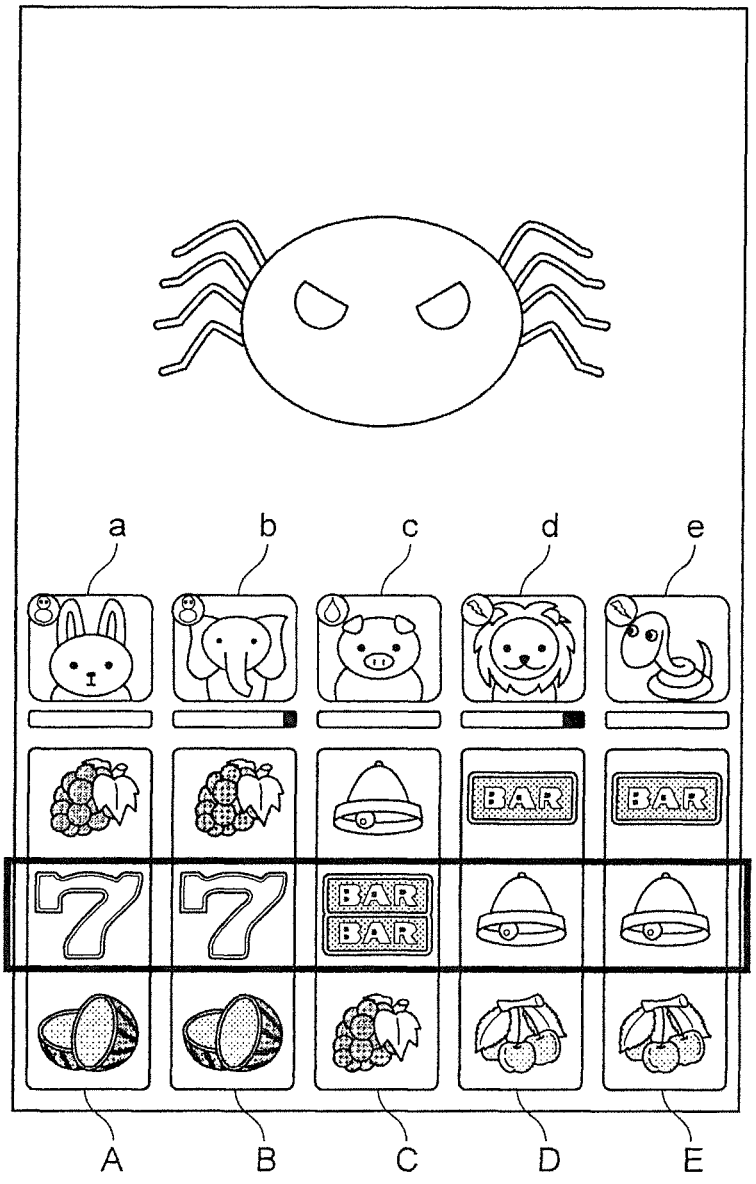
FIG. 7 is a schematic view illustrating an example of a game screen generated by the information processing apparatus.

FIG. 7 schematically illustrates an example of a game screen in the multi-play.

As illustrated in FIG. 7, players a to e can perform a stop operation for each of corresponding slots A to E.

As illustrated in FIG. 1, the information processing apparatus 100 can further include a communication unit 160.

The communication unit 160 communicates a message enabling communication relating to an intended combination of symbols among the plurality of players.

Figure 8:
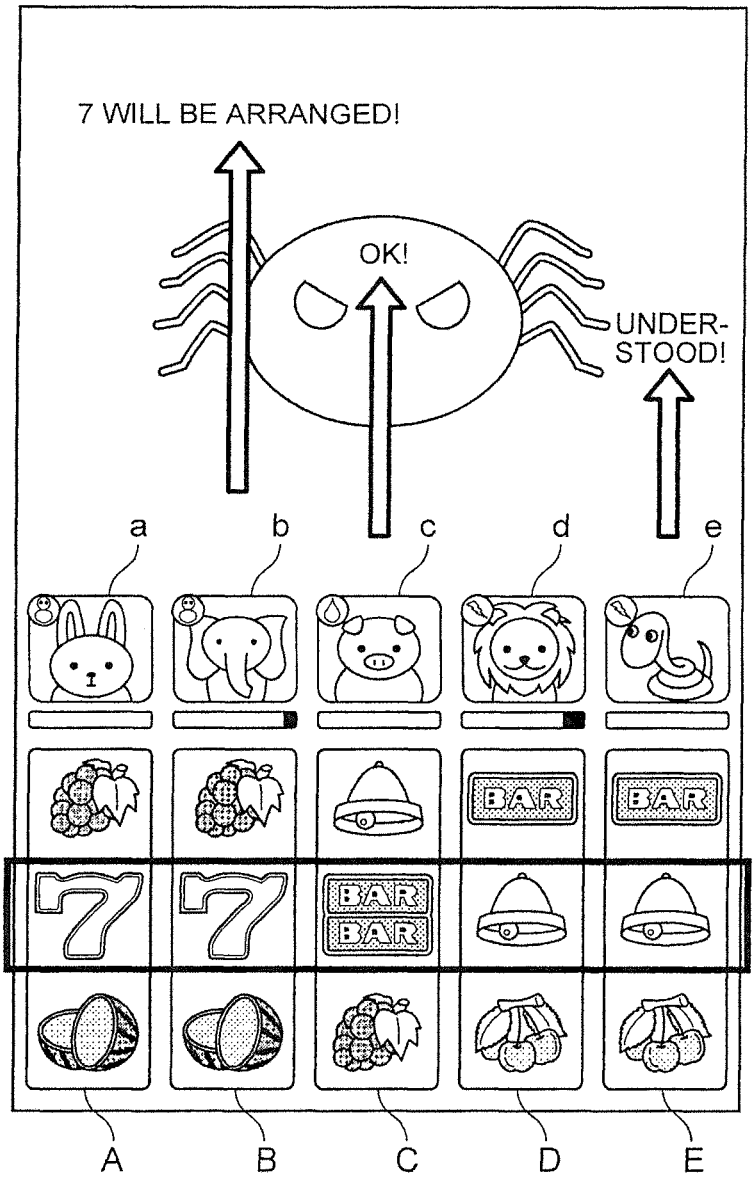
FIG. 8 is a schematic view illustrating an example of a game screen generated by the information processing apparatus.

For example, as illustrated in FIG. 8, the communication relating to the intended combination of symbols is a message, such as "7 will be arranged!", a response message thereto, or the like.

The message is preferably displayed such that a player who gives the message is understood. For example, as indicated by an arrow in the drawing, a display method can be used such that a message occurs near a slot of a player who gives the message and flows to the upper side of the screen.

The message can be arbitrarily input by the player or can be selected from a message list set in advance and input.

The information processing apparatus 100 can process the progress of a game in which a plurality of game contents including a game content corresponding to one player terminal 20 perform a battle.

The game is a game which is called a guild vs guild (GvG) battle and in which groups having a plurality of players perform a battle. For example, in a game in which a battle between one player and a character operated by a computer is mainly performed, it is assumed that a GvG battle is held as an event.

The information processing apparatus 100 can receive an instruction from the player terminal 20 which is a smart device with a touch panel as a main user interface.

The information processing apparatus 100 can receive an instruction from the player terminal with a physical key-equipped panel in which the physical key floats to the touch panel when the player gives an instruction. The physical key-equipped panel can be configured such that liquid disposed in the panel can be expanded at an appropriate timing in response to an instruction of a processing apparatus to make a physical key appear.

The information processing apparatus 100 may function as a server apparatus connected to the player terminal 20 through the network 10, or the player terminal 20 itself may include the information processing apparatus 100. In the former case, a game which is processed by the information processing apparatus 100 functions as a browser game, and in the latter case, the game functions as a native game.

When the information processing apparatus 100 functions as a server apparatus connected to the player terminal 20 through the network 10, a hybrid game in which the server apparatus and the player terminal carry out a part of processing to perform browser display in which the progress screen of the game is displayed in the player terminal 20 based on data generated by the server apparatus and native display in which other menu screens and the like are displayed by a native application installed on the player terminal 20.

Although when the player terminal 20 is an electronic device such as a smartphone has been described, a home video game machine which is a game dedicated machine, or a consumer machine such as a portable game machine may be used.

Subsequently, a game processing method will be described referring to the drawings.

Figure 9:
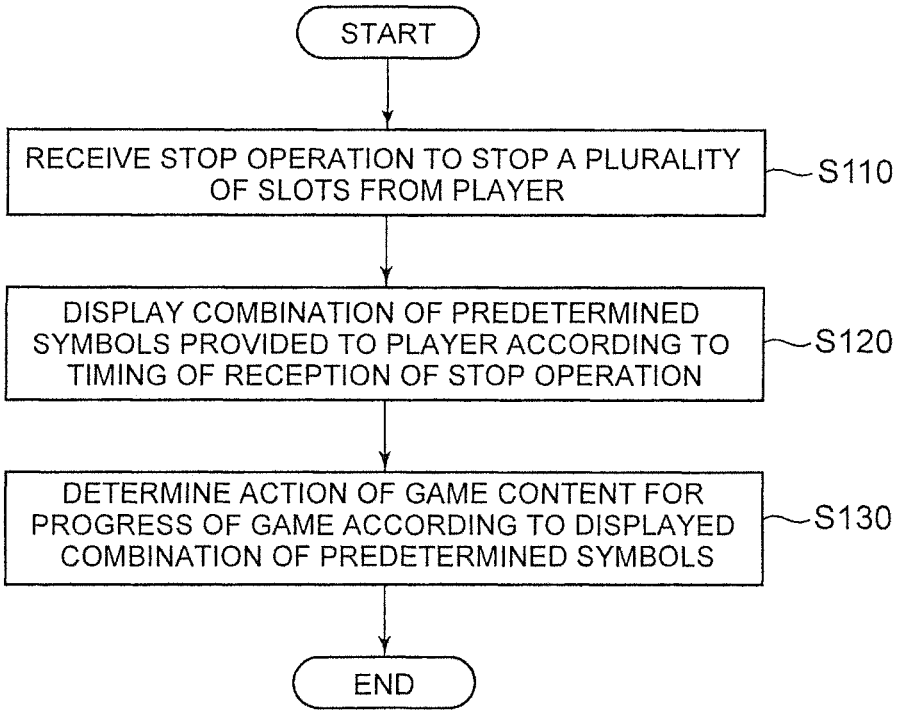
FIG. 9 is a flowchart illustrating the flow of a game processing method.

FIG. 9 is a flowchart illustrating an example of the flow of the game processing method. As illustrated in FIG. 9, the game processing method can process the progress of a game using a game content and causes a computer to process a reception step (S110), a display step (S120), and a determination step (S130). In the reception step (S110), a stop operation to stop a plurality of slots sequentially replacing and providing predetermined symbols to the player of the game is received from the player. This step can be processed by the reception unit 110.

In the display step (S120), a combination of the predetermined symbols provided to the player is displayed according to the timing of the reception of the stop operation in the reception step. This step can be processed by the display unit 120.

In the determination step (S130), an action of the game content for the progress of the game is determined according to the combination of the predetermined symbols displayed in the display step. This step can be processed by the determination unit 130.

Finally, a game program will be described.

The game program can process the progress of a game using a game content and causes a computer to realize a reception function, a display function, and a determination function.

The reception function receives a stop operation to stop a plurality of slots sequentially replacing and providing predetermined symbols to the player of the game from the player. This function can be realized by the reception unit 110.

The display function displays a combination of the predetermined symbols provided to the player according to the timing of the reception of the stop operation by the reception function. This function can be realized by the display unit 120.

The determination function determines an action of the game content for the progress of the game according to the combination of the predetermined symbols displayed by the display function. This function can be realized by the determination unit 130.

The game program can be provided in a state of being recorded in a computer-readable recording medium. The recording medium is not particularly limited, and a computer-readable recording medium, such as a CD-ROM or a DVD, may be used.

The game program can be created in, for example, a script language such as ActionScript or JavaScript (Registered Trademark), or an object-oriented programming language such as Objective-C or Java (Registered Trademark).

Alternatively, the game program may be created in, for example, a markup language such as HTML5.

The above-described configuration and operation is a representative example, and this disclosure is not limited to the example.

The invention claimed is:

1. A non-transitory computer readable recording medium storing a game program which processes progress of a game using a game content, the game content being electronic data used by a plurality of players for the progress of the game, which when executed by a computer, causes the computer to:

receive, from the plurality of players, stop operations to stop a plurality of slots sequentially replacing and providing predetermined symbols to the plurality of players of the game, each of the stop operations corresponding to one of the plurality of slots related to each of the plurality of players;

stop one of the plurality of slots related to each of the plurality of players according to timing of reception of the stop operation from that player, thereby displaying a combination of the predetermined symbols provided by the plurality of slots; and determine an action of the game content in the game according to the combination of the displayed predetermined symbols, wherein the game is progressed according to the action of the game content determined based on the stop operations.

2. The non-transitory computer readable recording medium according to claim 1, wherein the game program further causes the computer to:

store information of each of the plurality of slots in association with the game content.

3. The non-transitory computer readable recording medium according to claim 2, wherein each of the predetermined symbols in each of the plurality of slots is constituted based on information of attribute set in the associated game content.

4. The non-transitory computer readable recording medium according to claim 1, wherein the game program further causes the computer to:

increase and decrease at least one of a number of the plurality of slots and a speed at which each of the plurality of slots replaces respective predetermined symbol of the predetermined symbols.

5. The non-transitory computer readable recording medium according to claim 1, wherein the game program further causes the computer to:

communicate a message enabling communication relating to an intended combination of symbols among the plurality of players.

6. The recording medium according to claim 5, wherein the message is displayed in association with at least one of the plurality of slots.

7. The non-transitory computer readable recording medium according to claim 6, wherein the message is displayed in association with a first slot of the plurality of slots, the first slot corresponding to a first player of the plurality of players, the first player sending the message to other players of the plurality of players.

8. The non-transitory computer readable recording medium according to claim 1, wherein, in the game, at least one player of the plurality of players battles with another player, that does not belong to the plurality of players, or a computer-controlled character using the game content.

9. The non-transitory computer readable recording medium according to claim 1, wherein the determined action is an action of attack or defense against another player, that does not belong to the plurality of players, or the computer-controlled character.

10. A game processing method for controlling progress of a game using a game content, the game content being electronic data used by a plurality of players for the progress of the game, the game processing method comprising:

receiving, from the plurality of players, stop operations to stop a plurality of slots sequentially replacing and providing predetermined symbols to the plurality of players of the game, each of the stop operations corresponding to one of the plurality of slots related to each of the plurality of players;

stopping one of the plurality of slots related to each of the plurality of players according to timing of reception of the stop operation from that player, thereby displaying a combination of the predetermined symbols provided by the plurality of slots; and determining an action of the game content in the game according to the combination of the displayed predetermined symbols, wherein the game is progressed according to the action of the game content determined based on the stop operations.

11. The game processing method according to claim 10, further comprising:

storing information of each of the plurality of slots in association with the game content.

12. The game processing method according to claim 11, wherein each of the predetermined symbols in each of the plurality of slots is constituted based on information of attribute set in the associated game content.

13. The game processing method according to claim 10, further comprising:

increasing and decreasing at least one of a number of the plurality of slots and a speed at which each of the plurality of slots replaces respective predetermined symbol of the predetermined symbols.

14. The game processing method according to claim 10, further comprising:

communicating a message enabling communication relating to an intended combination of symbols among the plurality of players.

15. The game processing method according to claim 14, wherein the message is displayed in association with at least one of the plurality of slots.

16. The game processing method according to claim 15, wherein the message is displayed in association with a first slot of the plurality of slots, the first slot corresponding to a first player of the plurality of players, the first player sending the message to other players of the plurality of players.

17. An information processing apparatus for controlling a game program which processes progress of a game using a game content, the game content being electronic data used by a plurality of players for the progress of the game, the information processing apparatus comprising:

circuitry configured to:

receive, from the plurality of players, stop operations to stop a plurality of slots sequentially replacing and providing predetermined symbols to the plurality of players of the game, each of the stop operations corresponding to one of the plurality of slots related to each of the plurality of players;

stop one of the plurality of slots related to each of the plurality of players according to timing of reception of the stop operation from that player, thereby displaying a combination of the predetermined symbols provided by the plurality of slots; and determine an action of the game content in the game according to the combination of the displayed predetermined symbols, wherein the game is progressed according to the action of the game content determined based on the stop operations.

18. The information processing apparatus according to claim 17, wherein the circuitry is further configured to store information of each of the plurality of slots in association with the game content.

19. The information processing apparatus according to claim 18, wherein each of the predetermined symbols in each of the plurality of slots is constituted based on information of attribute set in the associated game content.

20. The information processing apparatus according to claim 17, wherein the circuitry is further configured to increase and decrease at least one of a number of the plurality of slots and a speed at which each of the plurality of slots replaces respective predetermined symbol of the predetermined symbols.

21. The information processing apparatus according to claim 17, wherein the circuitry is further configured to communicate a message enabling communication relating to an intended combination of symbols among the plurality of players.

22. The information processing apparatus according to claim 21, wherein the message is displayed in association with at least one of the plurality of slots.

23. The information processing apparatus according to claim 22, wherein the message is displayed in association with a first slot of the plurality of slots, the first slot corresponding to a first player of the plurality of players, the first player sending the message to other players of the plurality of players.

* * * * *